US011336025B2

(12) United States Patent
Andrews et al.

(10) Patent No.: US 11,336,025 B2
(45) Date of Patent: May 17, 2022

(54) ANTENNA ARRANGEMENT AND ASSOCIATED METHOD

(71) Applicant: Pet Technology Limited, London (GB)

(72) Inventors: James Andrews, London (GB); Brian Collins, London (GB); Thomas Blower, London (GB); Edward White, London (GB)

(73) Assignee: Pet Technology Limited, London (GB)

( * ) Notice: Subject to any disclaimer, the term of this patent is extended or adjusted under 35 U.S.C. 154(b) by 0 days.

(21) Appl. No.: 16/971,166

(22) PCT Filed: Feb. 20, 2019

(86) PCT No.: PCT/GB2019/050471
§ 371 (c)(1),
(2) Date: Aug. 19, 2020

(87) PCT Pub. No.: WO2019/162669
PCT Pub. Date: Aug. 29, 2019

(65) Prior Publication Data

US 2020/0381840 A1 Dec. 3, 2020

(30) Foreign Application Priority Data

Feb. 21, 2018 (GB) ..... 1802825
Feb. 20, 2019 (WO) ..... PCT/GB2019/050471

(51) Int. Cl.
*H01Q 19/22* (2006.01)
*H01Q 1/27* (2006.01)
*H01Q 9/04* (2006.01)

(52) U.S. Cl.
CPC ..... *H01Q 19/22* (2013.01); *H01Q 1/273* (2013.01); *H01Q 9/04* (2013.01)

(58) Field of Classification Search
CPC ..... H01Q 1/273; H01Q 19/22; H01Q 9/00; H01Q 9/04; H01Q 1/24; H01Q 1/243;
(Continued)

(56) References Cited

U.S. PATENT DOCUMENTS 3,054,107 A 9/1962 Engel et al.
4,479,130 A 10/1984 Snyder
(Continued)

FOREIGN PATENT DOCUMENTS

EP 1414107 B1 11/2005
EP 1962375 A1 8/2008
(Continued)

OTHER PUBLICATIONS

The International Search Report and the Written Opinion of the International Searching Authority, PCT application Serial No. PCT/GB2019/050471 (dated May 30, 2019).
(Continued)

*Primary Examiner* — Tho G Phan
(74) *Attorney, Agent, or Firm* — Kenneth E. Horton; Barnes & Thornburg LLP

(57) ABSTRACT

An antenna arrangement is disclosed, comprising a first body comprising a communications device including an antenna for transmitting and/or receiving signals via the antenna, and a second body comprising a conductive parasitic element for electromagnetic coupling with the antenna. The first body is physically separate from, or is removably attachable from, the second body. An associated method of transmitting and/or receiving signals is further disclosed.

13 Claims, 5 Drawing Sheets

(58) Field of Classification Search
CPC ..... H01Q 1/27; H01Q 1/22; H01Q 1/2283; H01Q 21/12
See application file for complete search history.

(56) References Cited

U.S. PATENT DOCUMENTS 4,631,546 A 12/1986 Dumas et al.
5,012,256 A 4/1991 Maddocks
5,210,542 A * 5/1993 Pett ..... H01Q 1/3275 343/700 MS
5,554,996 A 9/1996 Chatzipetros
5,572,223 A 11/1996 Phillips et al.
5,767,807 A 6/1998 Pritchett
5,771,025 A 6/1998 Reece et al.
5,923,305 A 7/1999 Sadler et al.
5,969,685 A * 10/1999 Hayes ..... H01Q 5/378 343/702
6,095,820 A 8/2000 Luxon et al.
6,134,421 A 10/2000 Lee et al.
6,198,943 B1 3/2001 Sadler et al.
6,249,255 B1 6/2001 Eggleston
6,262,685 B1 7/2001 Welch et al.
6,278,413 B1 8/2001 Hugh et al.
6,285,327 B1 9/2001 See
6,407,719 B1 6/2002 Ohira et al.
6,429,818 B1 8/2002 Johnson et al.
6,456,249 B1 * 9/2002 Johnson ..... H01Q 1/243 343/700 MS
6,486,836 B1 11/2002 Hill
6,492,942 B1 12/2002 Kezys
6,509,882 B2 * 1/2003 McKivergan ..... H01Q 1/245 343/700 MS
6,563,467 B1 5/2003 Buris et al.
6,639,560 B1 10/2003 Kadambi et al.
6,677,898 B2 1/2004 Cheng et al.
6,765,536 B2 7/2004 Phillips et al.
6,807,437 B1 10/2004 Andrus et al.
6,873,293 B2 3/2005 Proctor, Jr. et al.
6,888,505 B2 5/2005 Tran
6,891,506 B2 * 5/2005 Jarmuszewski ..... H01Q 1/243 343/702
6,917,337 B2 7/2005 Iida et al.
6,943,733 B2 9/2005 Vance
7,006,041 B2 2/2006 Fujii et al.
7,026,996 B2 4/2006 Harano
7,030,830 B2 4/2006 Azoulay et al.
7,050,010 B2 5/2006 Wang et al.
7,053,841 B2 5/2006 Ponce De Leon et al.
7,095,371 B2 8/2006 MOnebhurrun et al.
7,106,254 B2 9/2006 Jouvie et al.
7,109,924 B2 9/2006 Vance
7,136,019 B2 11/2006 Mikkola et al.
7,145,509 B2 12/2006 Ikuta et al.
7,187,339 B2 3/2007 Mori
7,265,731 B2 9/2007 Vance et al.
7,277,058 B2 10/2007 Faraone et al.
7,324,051 B2 1/2008 Hayes
7,324,054 B2 1/2008 Ozkar
7,330,152 B2 2/2008 Zhang et al.
7,342,552 B2 3/2008 Harano
7,345,634 B2 3/2008 Ozkar et al.
7,405,701 B2 7/2008 Ozkar
7,411,557 B2 * 8/2008 Shimizu ..... H01Q 1/243 343/702
7,425,928 B2 9/2008 Chiang et al.
7,457,650 B2 11/2008 Iwai et al.
7,495,619 B2 2/2009 Fossett
7,602,340 B2 10/2009 Sato
7,605,766 B2 * 10/2009 Dahlstrom ..... H01Q 1/243 343/700 MS
7,619,572 B2 11/2009 Su et al.
7,623,078 B2 11/2009 Wang
7,773,035 B2 8/2010 Murata et al.
7,817,103 B2 10/2010 Kersten et al.
7,847,740 B2 12/2010 Dunn et al.
8,174,457 B1 5/2012 Lam
8,378,847 B2 2/2013 Bartram et al.
8,384,600 B2 2/2013 Huang et al.
8,446,318 B2 5/2013 Ali et al.
8,514,130 B1 8/2013 Jensen et al.
8,526,935 B2 9/2013 Besore et al.
8,531,345 B2 9/2013 Ito et al.
8,553,550 B2 10/2013 Shiotsuki et al.
8,626,242 B2 1/2014 Ono
8,648,761 B2 2/2014 Ishibana et al.
8,659,495 B2 2/2014 Yanagi et al.
8,693,599 B2 4/2014 Araki et al.
8,711,043 B2 4/2014 Chen et al.
8,766,483 B2 7/2014 Cook et al.
8,797,224 B2 8/2014 Shinkai et al.
8,830,132 B1 9/2014 DOane et al.
8,907,853 B2 12/2014 Ying
8,963,774 B1 2/2015 Livadaru et al.
8,988,298 B1 3/2015 Akhoondzadehas et al.
9,126,490 B2 9/2015 Cook et al.
9,203,139 B2 12/2015 Zhu et al.
9,209,524 B2 12/2015 Hirai
9,219,308 B2 12/2015 Ali et al.
9,263,798 B1 2/2016 Piazza et al.
9,270,015 B2 2/2016 Harper
9,293,814 B2 3/2016 Ozden
9,337,537 B2 5/2016 Hu et al.
9,419,338 B2 8/2016 Chiu
9,431,717 B1 8/2016 Lee et al.
9,437,926 B2 9/2016 Azad et al.
9,455,497 B2 9/2016 Wu
9,472,850 B2 10/2016 Chiu
9,484,633 B2 11/2016 Oh
9,502,750 B2 11/2016 Yarga et al.
9,531,058 B2 12/2016 Isohatala
9,548,538 B2 1/2017 Bengtsson et al.
9,553,356 B2 1/2017 Chang et al.
9,583,824 B2 2/2017 Zhang et al.
9,597,516 B2 3/2017 Lee et al.
9,601,272 B2 3/2017 Ahn et al.
9,640,868 B2 5/2017 Peng et al.
9,653,777 B2 5/2017 Guterman et al.
9,711,866 B1 7/2017 Doane et al.
9,722,325 B2 8/2017 Svendsen et al.
9,761,951 B2 9/2017 Kuonanoja
2003/0045324 A1 3/2003 Nagumo et al.
2004/0032370 A1 2/2004 Ito et al.
2004/0219956 A1 11/2004 Iwai et al.
2006/0011146 A1 1/2006 Kates
2007/0210965 A1 9/2007 Takada et al.
2008/0094293 A1 4/2008 Chang et al.
2010/0141536 A1 6/2010 Zhang et al.
2010/0231053 A1 9/2010 Karalis et al.
2010/0311325 A1 12/2010 Marshall
2010/0328164 A1 12/2010 Huynh
2012/0075156 A1 3/2012 Noguchi et al.
2012/0194976 A1 8/2012 Golko et al.
2012/0256800 A1 10/2012 Kuonanoja
2013/0141291 A1 6/2013 Luan
2013/0194136 A1 8/2013 Handro et al.
2013/0293427 A1 11/2013 Zhang et al.
2014/0285385 A1 9/2014 Aok et al.
2015/0084814 A1 3/2015 Rojanski et al.
2015/0236421 A1 8/2015 Zemlakov
2015/0255859 A1 9/2015 Harper
2016/0072536 A1 3/2016 Wang
2016/0112147 A1 4/2016 Seo et al.
2016/0141757 A1 5/2016 Lai et al.
2016/0204520 A1 7/2016 Dong et al.
2016/0204646 A1 7/2016 Park et al.
2017/0047635 A1 2/2017 Wolentarski et al.
2017/0062924 A1 3/2017 Lee et al.
2017/0117623 A1 4/2017 Chan et al.

(56) References Cited

U.S. PATENT DOCUMENTS

| | | | |
|---|---|---|---|
| 2017/0179599 | A1 | 6/2017 | Bevelacqua et al. |
| 2017/0201007 | A1 | 7/2017 | Mura |

FOREIGN PATENT DOCUMENTS

| | | | |
|---|---|---|---|
| EP | 2019448 | A1 | 1/2009 |
| EP | 2081253 | A1 | 7/2009 |
| EP | 1973193 | B1 | 10/2012 |
| EP | 3065330 | A1 | 9/2016 |
| EP | 2621015 | B1 | 8/2017 |
| GB | 2516552 | A | 1/2015 |
| WO | 2002071536 | A1 | 9/2002 |
| WO | 2008081077 | A1 | 7/2008 |
| WO | 2010122220 | A1 | 10/2010 |
| WO | 2010139120 | A1 | 12/2010 |
| WO | 2013107921 | A1 | 7/2013 |
| WO | 2015038038 | A1 | 3/2015 |

OTHER PUBLICATIONS

Search Report, GB Application No. GB1802825.8 (dated Aug. 20, 2018) pp. 4.

* cited by examiner

ANTENNA ARRANGEMENT AND ASSOCIATED METHOD

FIELD OF THE INVENTION

An aspect of the present invention relates to an antenna arrangement, and in particular to an arrangement comprising an antenna with parasitic conductor. A further aspect relates to an associated method of transmitting and/or receiving signals.

BACKGROUND

It is well known in antenna engineering that there is an intrinsic limit to the efficiency and bandwidth of an antenna that has physical dimensions that are significantly less than a half wavelength at its operating frequency. The relationship between dimensions and the Q-factor of an antenna are generally described by the Chu-Harrington limit. (Chu, L. J. (December 1948). "Physical limitations of omnidirectional antennas". *Journal of Applied Physics*. 19: 1163-1175, and Harrington, R. F. (1960). "Effects of antenna size on gain, bandwidth, and efficiency". *Jour. Nat'l Bureau of Standards*. Washington D.C. USA: US National Bureau of Standards. 64-D: 1-12.) Such antennas are generally referred to as electrically small antennas.

There are many practical applications for electrically small antennas. The propagation characteristics of frequencies between around 400 MHz and 1000 MHz makes them very suitable for a wide range of communications applications including devices connected to mobile radio networks and devices for short range communications. In many of these applications it is desirable for the communicating device to be physically small, which places constraints on the size of antenna which may be used, and consequentially limits the operating (transmission and/or reception) range of devices using existing electrically small antenna arrangements. Also, the use of an external antenna to increase range is typically inconvenient or impractical in such applications, and hence undesirable.

An aspect of the present invention seeks to ameliorate the drawbacks with existing antenna arrangements discussed above.

STATEMENTS OF INVENTION

According to a first aspect of the present invention, there is provided an antenna arrangement comprising a first body comprising a communications device including an antenna for transmitting and/or receiving signals via the antenna, and a second body comprising a conductive parasitic element for electromagnetic coupling with the antenna, wherein the first body is physically separate from, or is removably attachable from, the second body.

Preferably, the antenna comprises an electrically small antenna.

Preferably, the overall length of the conductive parasitic element is longer than the overall length of the antenna.

Preferably, the developed length of the conductive parasitic element is such that the conductive parasitic element is resonant at an operating frequency at which the communications device receives and/or transmits signals via the antenna.

Preferably, the second body further comprises a support on or in which the conductive parasitic element is provided.

Preferably, the support physically protects the conductive parasitic element and/or facilitates the attachment of the conductive parasitic element to another object, person or animal.

Preferably, the support comprises a collar or strap to facilitate attachment to another object, person or animal.

Preferably, the communications device further comprises a housing in which the antenna is located.

Preferably, the housing is removably attachable from the support.

Preferably, the communications device further comprises communication circuitry electrically connected to the antenna and located within the housing.

Preferably, void spaces within the housing are filled with a packing material.

Preferably, the communications device further comprises a battery, and the first body is removably attachable from the second body to facilitate replacement or recharging of the battery.

According to a second aspect of the present invention, there is provided the first body of the first aspect.

According to a third aspect of the present invention, there is provided the second body of the first aspect.

According to a fourth aspect of the present invention, there is provided a method of transmitting and/or receiving signals via the antenna of the antenna arrangement of the first aspect, wherein the method comprises transmitting and/or receiving signals via the antenna with the conductive parasitic element electromagnetically coupled with the antenna.

Preferably, the method of the fourth aspect comprises transmitting and/or receiving signals via the antenna with the conductive parasitic element electromagnetically coupled the antenna and with the first body spaced from the second body.

An embodiment of the present invention provides an arrangement whereby a small self-contained radio device provided with an electrically small antenna operates cooperatively with a physically separate parasitically-excited radiating element having larger dimensions, enabling the achievement of enhanced radiating properties. This provides the communication device with extended range of transmission and/or reception compared with that provided by an equivalent device without the parasitic element.

In an exemplary implementation of an embodiment of the present invention, the parasitic conductor is embedded in a collar for an animal such as a dog or cat, while the radio device is a separate unit operating in conjunction with the embedded conductor yet being easily detached for charging or other purpose, without the need to remove the entire collar from the animal. Removing and refitting the radio-communications device can be accomplished with much less disturbance to the host animal than removing and refitting a collar.

It will however also be appreciated that embodiments of the present invention may equally be applied in a wide range of further potential applications in which usage of a small antenna package is desirable, for example in wearable technology, such as a smartphone device for transmitting and/or receiving data via an electrically small antenna.

DESCRIPTION OF DRAWINGS

In order that the present invention may be more readily understood, embodiments thereof will now be described, by way of example only, with reference to the accompanying drawings, of which.

DETAILED DESCRIPTION OF EXEMPLARY EMBODIMENTS

Figure 1:
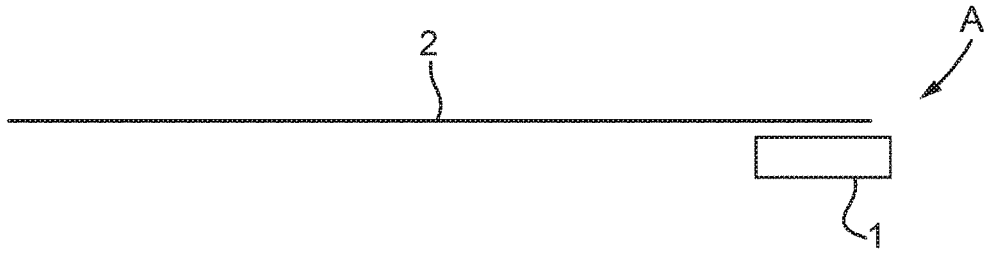
FIG. 1 is a schematic diagram showing a first embodiment of an antenna arrangement according to an aspect of the present invention.

FIG. 1 schematically shows generally at "A" a first embodiment of an antenna arrangement according to the present invention, comprising a small communications device 1 having radiocommunications circuits (for example, for reception and/or transmission of radio signals) and an internal electrically small antenna, the whole being proximate to, but physically separate or separable from, an elongate conductive parasitic element 2 electromagnetically coupled to the internal electrically small antenna within the communications device 1.

Figure 2:
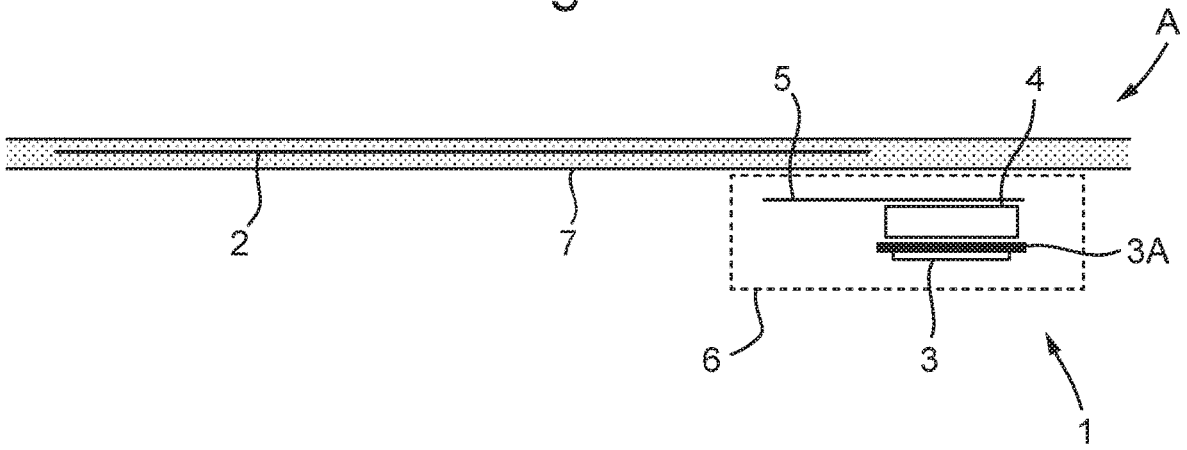
FIG. 2 schematically shows the first embodiment in greater detail.

FIG. 2 is a more detailed schematic view of the first embodiment, showing the radiocommunication circuits 3 of the communications device 1 assembled on at least one printed circuit board 3*a*, together with a battery 4 and an internal electrically small antenna 5 contained within a housing 6 shown in phantom in the Figure and which is preferably formed, in whole or in part, from a dielectric material. For example, the housing 6 may be made from ABS (acrylonitrile-butadiene styrene), PC (polycarbonate), PC/ABS co-polymer or other non-metallic engineering materials such as engineering thermoplastic materials or composite materials. Depending upon the intended application, the void spaces within the housing 6 may preferably be filled with a dielectric material having a low permittivity, such as rigid or flexible plastic foam, in order to avoid water ingress.

According to embodiments, the communications device 1 may for example support the transmission of any public or proprietary standard of radio transmission, for example IEEE 802.11 (WiFi), IEEE 802.15 (Bluetooth® and related standards) and may have provision for connection to an external battery charger in the event that the battery 4 is rechargeable.

The elongate parasitic element 2 comprises an electrically-conductive element and may for example be formed from conductive wire, conductive tape or conductive threads. Depending upon the desired implementation, the elongate parasitic element 2 may be provided so as to lie on the surface of, or be contained within, a support 7, which may be either rigid or flexible. This support 7 acts to protect the elongate parasitic element, and/or to facilitate its attachment to another object or to a person or animal, and is preferably formed, in whole or in part, from non-conductive material, for example woven or injection moulded plastics, fabric, leather or other suitable material. By way of illustration, in the preferred exemplary implementation discussed below in relation to FIG. 8, the elongate parasitic element 2 lies on the surface of, or is contained within, a non-conductive material support 7 forming a collar for an animal. Also, the support 7 may allow for attachment between the support 7 and the housing 6 of the communications device 1, and in particular for removable attachment between those elements.

The developed length of the conductive parasitic element 2 is preferably approximately one half wavelength at the operating frequency of the communications device 1, but its developed length is preferably adjusted such that the conductive parasitic element is resonant at an operating frequency at which the communications device receives and/or transmits signals via the antenna. In particular, the developed length of the conductive parasitic element may be adjusted to accommodate the effects of dielectric loading caused (where applicable) by the material of the support 7, and loading effects caused by the electromagnetic interaction of the parasitic element 2 with the communications device 1. Such adjustment may be made by practical measurements of the gain or efficiency of the arrangement. The conductive parasitic element may be meandered or otherwise shaped such that its overall length is less than its developed length.

In the present specification, the "developed" length of the conductive parasitic element 2 means its full length from end to end, measured along the conductive parasitic element 2 itself, whereas the "overall" length of the conductive parasitic element 2 is the largest linear dimension of the area occupied by the conductive parasitic element 2. References to the developed and/or overall length of other elements, such as the antenna, are to be considered accordingly.

The parasitic conductive element 2 may be meandered to reduce its overall length (for example, to reduce its overall length within an animal collar 7—see discussion of FIG. 8 below), but its effectiveness will be reduced as the overall length is reduced.

Figure 3:
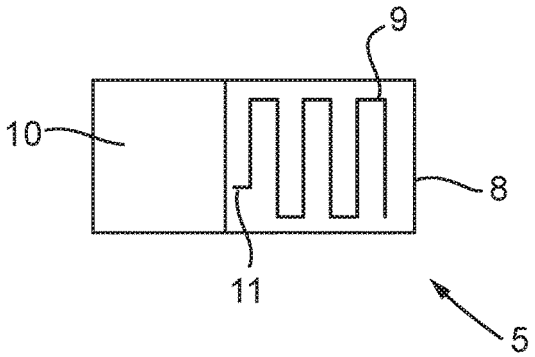
FIG. 3 schematically shows an internal electrically small antenna suitable for use in an embodiment of the present invention.

FIG. 3 shows a typical form for the internal electrically small antenna 5, suitable for use in embodiments of the present invention such as the present embodiment. The internal electrically small antenna 5 comprises a printed circuit laminate 8 on which are formed by etching or otherwise a meandered or serpentine conductive radiating element 9 and an area of conductive groundplane 10. The lamina 8 may for example take the form of a rigid printed circuit laminate, a flexible laminate or a compound multilayer laminate comprising both rigid and flexible layers in accordance with the current state of the art. The internal electrically small antenna 5 is fed with radio signals at the feedpoint 11 which may be connected directly to circuit elements on the same printed circuit laminate, or by a coaxial cable to circuit elements which may be accommodated on a separate printed circuit assembly, such as the radiocommunication circuits 3 shown in FIG. 2.

To use the arrangement of FIGS. 1 and 2, a user simply locates the communications device 1 adjacent the parasitic conductive element 2, and then transmits or receives signals via the electrically small antenna 5 of the communications device 1. It is not necessary that the communications device 1 actually be brought into physical contact with the parasitic conductive element 2; all that is necessary is for the communications device 1 to be sufficiently close to the parasitic element for electromagnetic coupling to occur, to the extent that a boost in transmission/reception range be observable.

Figure 4:
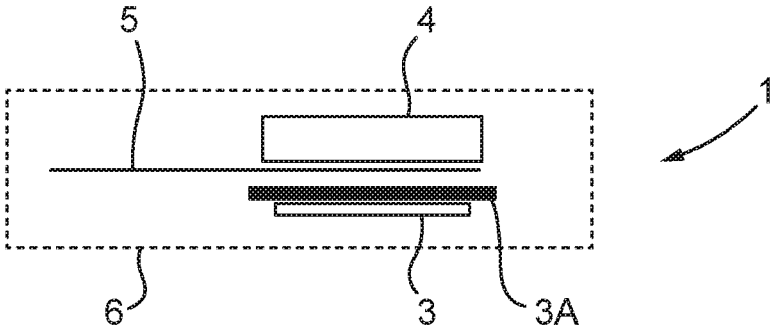
FIG. 4 schematically shows a communications device according to a second embodiment.
Figure 5:
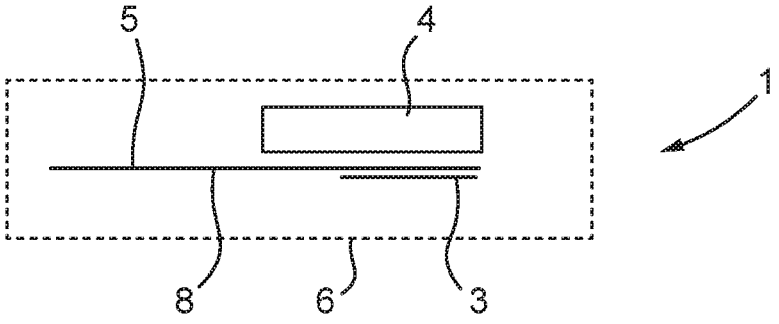
FIG. 5 schematically shows a communications device according to a third embodiment.

FIGS. 4 and 5 show second and third alternate embodiments of the communications device 1, respectively, in which like parts are given like reference numerals.

In the second embodiment of FIG. 4, the internal electrically small antenna 5 is situated with its conductive groundplane 10 between the printed circuit board 3*a* of the radiocommunication circuits 3 and a battery 4, and its conductive radiating element 9 projecting beyond the printed circuit board 3*a* and the battery 4.

In the third embodiment of FIG. 5, the separate printed circuit board 3*a* of the radiocommunication circuits 3 is omitted, and the radiocommunication circuits 3 are instead accommodated on the same printed circuit laminate 8 on which is formed the meandered conductive radiating element 9 of the internal electrically small antenna 5.

The effectiveness of the invention has been experimentally demonstrated by the inventors, by measurement of the gain or efficiency of the communications device 1 with its internal electrically small antenna 5 functioning alone, compared with a further measurement made with communications device 1 proximate to the parasitic element 2.

Figure 6:
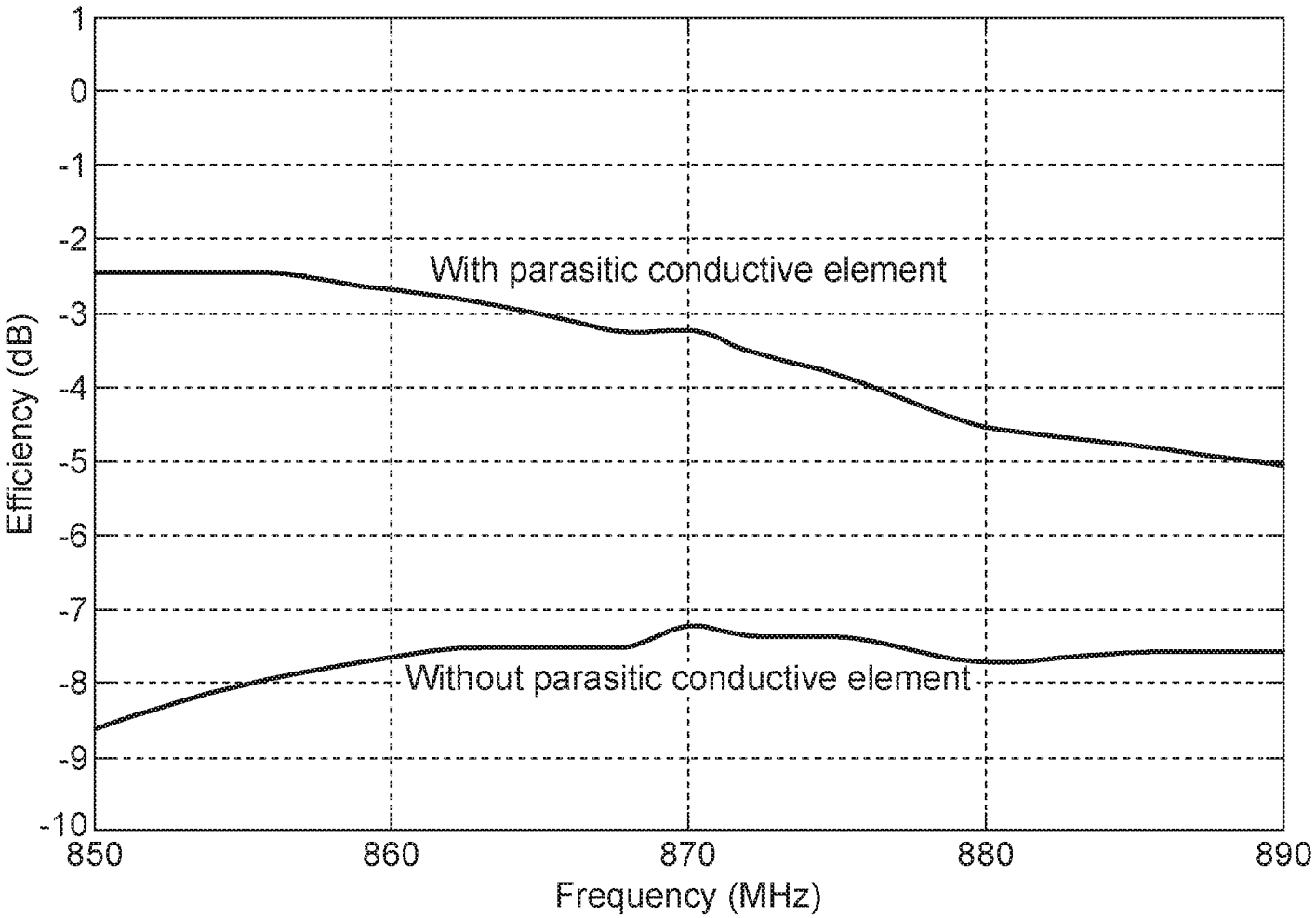
FIGS. 6 and 7 are graphs of experimental results according to embodiments of the present invention.

As an example, FIG. 6 illustrates the measured efficiency of a self-contained communications device 1 configured according to the first embodiment described above operated alone and in conjunction with a linear conductive parasitic element 2 in accordance with an embodiment of the present invention. The graphs illustrate the efficiency (in dB relative to a perfect lossless antenna) as a function of the frequency (in MHz). In this test, the communication device 1 was operated to transmit signals at an operating frequency of 868 MHz, and the efficiency of the internal electrically small antenna 5 shown in the Figures was based upon the strength of signal received at a distance of 2.5 metres from the communications device 1. In this test, a strip of copper tape having a length of approximately 15 cm was employed as the linear conductive parasitic element 2, although subsequent testing demonstrated the same general trend of signal boost shown in the Figure being observable by employing, as the linear conductive parasitic element 2, any one of a wide range of metal or metallic objects (for example, a length of metal wire) having a length of around 13 to 15 cm. Testing also demonstrated that spacing the linear conductive parasitic element 2 from the communication device 1 by between around 6 mm to 10 mm showed the appreciable increase in antenna efficiency with this particular arrangement evidenced by the present Figure, although the improvement was seen to decrease when the spacing exceeded around 8 mm.

Figure 7:
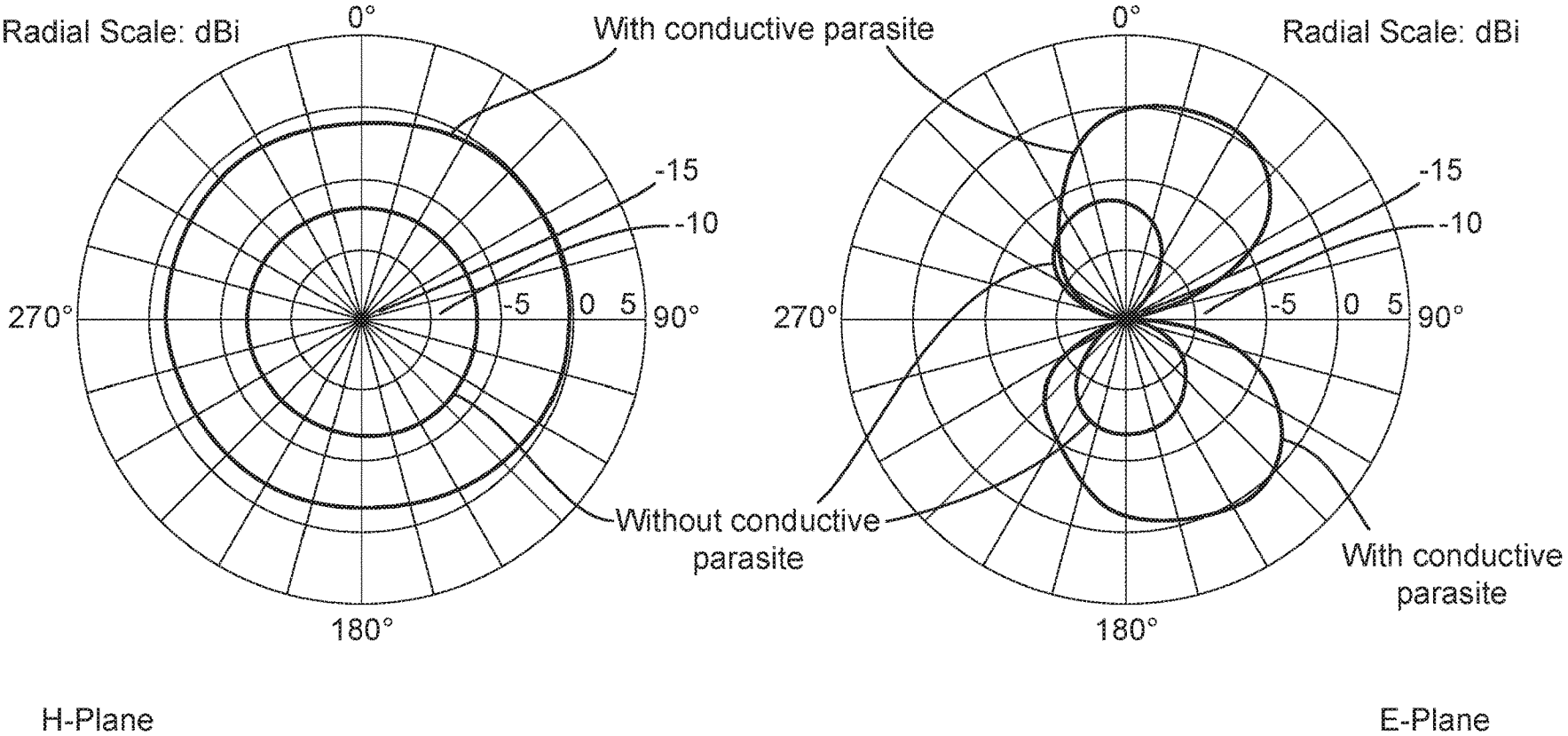

FIG. 7 illustrates the measured radiation patterns of the self-contained communications device 1, of the same arrangement used to produce the results shown in FIG. 6, operated alone and in conjunction with the linear conductive parasitic element 2. These polar graphs are plotted with a radial scale showing the gain of the communication device 1 in decibels relative to an isotropic radiator (dBi) and illustrate the radiation patterns in the E-plane (containing the parasitic conductor 2) and H-plane (orthogonal to the longitudinal direction of the elongate parasitic conductor 2) for the communications device 1 alone or with a proximate parasitic radiator 2, as labelled in the graphs themselves. The difference between the two measured radiation patterns illustrates an effective increase in gain of 5 dB.

Figure 8:
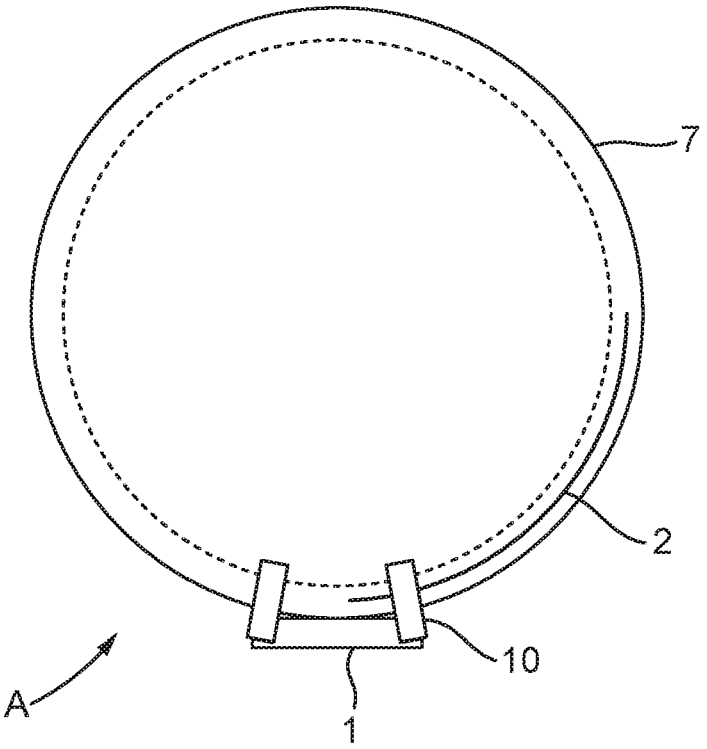
FIG. 8 schematically shows a pet collar according to an embodiment of the present invention.

FIG. 8 shows an exemplary implementation of the present invention, in which an antenna arrangement A according to an embodiment of the present invention (for example, the first embodiment described above with reference to FIGS. 1 and 2) is employed as a transmitter and/or receiver device in an animal monitoring system (such as the animal monitoring system described in GB Patent Application No. 1614880.1, the contents of which are hereby incorporated by reference), in which radio transmissions made by the electronics communication device 1 contain data relating, for example, to the location, activity, metabolism or health status of the host animal wearing the arrangement A.

According to this implementation, the electronics communication device 1 is physically and removably connected by at least one attachment device 10 to a support in the form of an animal collar 7 containing the parasitic conductor 2. Such at least one attachment device 10 may by way of example comprise hooks, rings or latches, or fabric hook-and-loop fasteners (such as Velcro®). The collar 7 itself may for example be made from woven or injection moulded plastics, fabric, leather or other suitable material, and may be provided on or around the host animal in a convenient location e.g. around the neck of the animal. The collar may include the usual features associated with typical pet collars, such as a buckle.

Usage of an embodiment of the present invention in this type of implementation has particular utility, as it allows for the electronics communication device 1 to transmit/receive monitoring data over a wider range than would otherwise be possible, without noticeably adding to the size of the arrangement A to be worn by the pet or animal (and indeed which adds little to the size of a conventional collar which a pet might otherwise be wearing), which allows for the electronics communication device 1 to be provided as a small package, and which allows for the electronics communication device 1 to be readily detached from the collar 7 e.g. for recharging or replacement of a battery, testing, repair or maintenance.

Although embodiments of the invention have beneficial utility in the pet monitoring system described above, it will be appreciated that embodiments of the invention are widely applicable to a range of other applications in which a small communications package, with an improved transmission range, is desirable. For example, embodiments of the present invention may be applied to wearable technology, such as smartwatches arranged to transmit and/or receive data. In such an application, the elongate parasitic conductor 2 may be provided on or in the strap of the smartwatch, thus not noticeably adding to the size of device which a user of a smartwatch would otherwise be wearing.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Thus, the foregoing embodiments of the invention have been described by way of example only. It will be appreciated by a person skilled in the art that various modifications can be made without departing from the scope of the invention as defined by the claims.

For example, it will be recognised by those skilled in the art that other configurations, such as a meandered inverted-F, are possible for the electrically small antenna 5 according to embodiments of the present invention. Yet further, in the example of FIG. 3 described above, the electrically small antenna 5 comprises a meandered conductive radiating element 9, to reduce the overall length of the electrically small antenna 1. However, it is not necessary that the electrically small antenna be meandered or otherwise comprise a meandered conductive radiating element, and the overall length of the electrically small antenna may be reduced in other ways. For example, the electrically small antenna may instead comprise a notch or loop antenna, such as is described in WO2015011468 A1, the contents of which are hereby incorporated by reference.

The invention claimed is:

1. An antenna arrangement comprising a first body comprising a communications device including an antenna for transmitting and/or receiving signals via the antenna, and a second body comprising a conductive parasitic element for electromagnetic coupling with the antenna and a support on or in which the conductive parasitic element is provided, wherein the support comprises an animal collar which facilitates the attachment of the conductive parasitic element to an animal and wherein the first body is removably attachable from the animal collar without removing the animal collar from the animal.

2. The antenna arrangement of claim 1, wherein the antenna comprises an electrically small antenna.

3. The antenna arrangement of claim 1, wherein the overall length of the conductive parasitic element is longer than the overall length of the antenna.

4. The antenna arrangement of claim 1, wherein the developed length of the conductive parasitic element is such that the conductive parasitic element is resonant at an operating frequency at which the communications device receives and/or transmits signals via the antenna.

5. The antenna arrangement of claim 1, wherein the support physically protects the conductive parasitic element.

6. The antenna arrangement of claim 1, wherein the communications device further comprises a housing in which the antenna is located.

7. The antenna arrangement of claim 6, wherein the housing is removably attachable from the animal collar.

8. The antenna arrangement of claim 6, wherein the communications device further comprises communication circuitry electrically connected to the antenna and located within the housing.

9. The antenna arrangement of claim 6, wherein void spaces within the housing are filled with a packing material.

10. The antenna arrangement of claim 6, wherein the communications device further comprises a battery, and wherein the first body is removably attachable from the animal collar to facilitate replacement or recharging of the battery.

11. The first body of the antenna arrangement of claim 1.

12. The second body of the antenna arrangement of claim 11.

13. A method of transmitting and/or receiving signals via the antenna of the antenna arrangement of claim 1, wherein the method comprises attaching the animal collar to an animal, transmitting and/or receiving signals via the antenna with the conductive parasitic element electromagnetically coupled with the antenna, and removing the first body from the animal collar without removing the animal collar from the animal.

* * * * *